US006884321B2

(12) United States Patent
Erb, Jr. et al.

(10) Patent No.: US 6,884,321 B2
(45) Date of Patent: Apr. 26, 2005

(54) FIREBLOCKING/INSULATING PAPER

(75) Inventors: David F. Erb, Jr., Readfield, ME (US); Eric D. Ritter, Monmouth, ME (US); Lisa B. Stang, Wayne, ME (US)

(73) Assignee: Tex Tech Industries, Inc., North Monmouth, ME (US)

( * ) Notice: Subject to any disclaimer, the term of this patent is extended or adjusted under 35 U.S.C. 154(b) by 0 days.

(21) Appl. No.: 10/247,997

(22) Filed: Sep. 20, 2002

(65) Prior Publication Data

US 2003/0099833 A1 May 29, 2003

Related U.S. Application Data

(60) Provisional application No. 60/323,389, filed on Sep. 20, 2001.

(51) Int. Cl.[7] ..... D21H 13/12; D21H 13/36

(52) U.S. Cl. ..... 162/145; 162/135; 162/146; 162/164.1; 162/168.1; 162/181.1

(58) Field of Search ..... 162/145, 150, 162/135, 168.1, 146, 164.1, 181.1

(56) References Cited

U.S. PATENT DOCUMENTS

| | | | | |
|---|---|---|---|---|
| 3,253,978 | A | 5/1966 | Bodendorf et al. | |
| 3,702,279 | A | 11/1972 | Ardary et al. | |
| 3,749,638 | A * | 7/1973 | Renaud et al. | 162/157 |
| 3,979,253 | A | 9/1976 | Clark | |
| 4,057,678 | A | 11/1977 | Walker, Jr. | |
| 4,243,715 | A | 1/1981 | Gordon | |
| 4,398,931 | A | 8/1983 | Shevlin | |
| 4,421,599 | A | 12/1983 | Kuzuoka et al. | |
| 4,543,113 | A | 9/1985 | Forester et al. | |
| 4,746,403 | A | 5/1988 | Ko et al. | |
| 4,762,643 | A | 8/1988 | Bohrn et al. | |
| 4,789,430 | A | 12/1988 | Fredenucci | |
| 4,885,058 | A | 12/1989 | Hani et al. | |
| 4,912,067 | A | 3/1990 | Garman | |
| 5,053,107 | A | 10/1991 | Barber, Jr. | |
| 5,145,811 | A | 9/1992 | Lintz et al. | |
| 5,294,299 | A | 3/1994 | Zeuner et al. | |
| 5,342,650 | A | 8/1994 | Daly, III | |
| 5,419,975 | A | 5/1995 | Lintz et al. | |
| 5,460,864 | A | 10/1995 | Heitkamp | |
| 5,480,697 | A | 1/1996 | Böttger et al. | |
| 5,552,049 | A | 9/1996 | Gray | |
| 5,567,536 | A | 10/1996 | Lintz et al. | |
| 5,569,343 | A | 10/1996 | Garrigus | |
| 5,582,893 | A | 12/1996 | Böttger et al. | |
| 5,679,433 | A | 10/1997 | Hayashi et al. | |
| 5,714,025 | A | 2/1998 | Brungardt | |
| 5,989,736 | A | 11/1999 | Lintz et al. | |
| 6,025,288 | A | 2/2000 | Zoitos et al. | |
| 6,030,910 | A | 2/2000 | Zoitos et al. | |
| 6,062,569 | A | 5/2000 | Strasser et al. | |
| 6,120,643 | A | 9/2000 | Levit | |
| 6,135,006 | A | 10/2000 | Strasser et al. | |
| 6,143,819 | A | 11/2000 | Nakanishi | |
| 6,155,432 | A | 12/2000 | Wilson et al. | |
| 6,210,786 | B1 | 4/2001 | Atmur et al. | |

FOREIGN PATENT DOCUMENTS

| | | |
|---|---|---|
| EP | 0 027 705 | 3/1983 |
| EP | 0 109 782 | 5/1984 |
| WO | 98/51631 | 11/1998 |

OTHER PUBLICATIONS

O.A. Battista et al. Synthetic Fibers in Papermaking, Interscience Publishers, a Division of John Wiley & Sons, Inc. (1964) pp. 101.

* cited by examiner

*Primary Examiner*—Peter Chin
(74) *Attorney, Agent, or Firm*—Fitzpatrick, Cella, Harper & Scinto

(57) ABSTRACT

A flame and heat resistant paper is disclosed having high burnthrough prevention capability, as required in aircraft applications. The paper is prepared from modified aluminum oxide silica fibers, in addition to other components, and has exceptional tensile strength and flexibility as compared to conventional inorganic papers.

26 Claims, 9 Drawing Sheets

FIREBLOCKING/INSULATING PAPER

This application claims the benefit of priority of U.S. Provisional Application No. 60/323,389, filed Sep. 20, 2001, herein incorporated by reference.

BACKGROUND OF THE INVENTION

1. Field of the Invention

This invention relates to a sheet material, hereinafter referred to as paper, having fireblocking and thermal insulating properties. In preferred embodiments, a paper according to the invention will prevent the propagation and burnthrough of a fire in aircraft according to the specifications in Title 14 of the U.S. Code of Federal Regulations Part 25, Parts VI and VII to Appendix F thereof, and in proposed changes to said Regulations, published September 2000 in the Federal Register, Vol. 65, No. 183, pages 56992–57022, herein incorporated by reference, and collectively referred to herein as the "FAA requirements."

2. Description of the Related Art

Paper is made from fibers, and optionally other materials, dispersed in a liquid medium and deliquified, usually by placing on a screen and then applying pressure to make a sheet. Paper in the conventional sense is usually made from vegetable fibers, such as cellulose, dispersed in an aqueous medium usually with binder and filler, deposited on a rotary screen and rolled. However, "paper" as a broad term, as used herein, covers any fiber-based material in sheet form which can be made using papermaking technology.

Paper made of inorganic fibers tends to have lower tensile strength and lower flexibility than paper comprising large amounts of organic fibers. Partly, this is because the stiffer inorganic fibers have less ability to intertwine and form a stable sheet. Papers comprising organic fibers, such as cellulose, rely on strong hydrogen bonds to provide tensile strength to the sheet. These hydrogen bonds, formed as a result of the polar attraction between water and hydroxyl groups covering the surface of the cellulose fiber, are not possible with typical inorganic fibers (such as glass, silica and quartz). Making paper out of inorganic fiber materials having high heat and flame resistance, which retains flexibility and tensile strength, poses significant technical challenges.

U.S. Pat. No. 5,053,107 describes an organic-free ceramic paper for use in high temperature environments containing glass fiber as a binder. However, this paper lacks flexibility in general and becomes very brittle at temperatures above 1200° F., making it unsuitable for use in high temperature applications.

U.S. Pat. No. 5,567,536 discloses a porous paper including inorganic ceramic fibers with an inorganic silica fiber binder system that initially includes organic materials. The organics, which are present for strength in the forming process, are subsequently combusted out after the paper has been produced and prior to the end use application. This results in a weak paper with only about 5 grams per inch of tensile strength per pound of basis weight. Such a weak paper would be likely to tear apart or rip during handling if it were installed as a fire barrier in an aircraft fuselage.

U.S. Pat. No. 4,885,058 discloses a paper which includes inorganic fibers and organic fibers as a binding agent. The tensile strength of the materials disclosed is generally poor. Moreover, the cellulosic fiber content of these materials causes the paper to burn at relatively low temperatures.

U.S. Pat. No. 4,746,403 describes a sheet material for high temperature use also having water resistance. The sheet comprises a glass fabric mat embedded in a layered silicate material. Although "paper-like," the sheet material is not prepared from a fibrous dispersion utilizing papermaking technology. The disclosed materials are not waterproof or impervious to water, but described as not substantially degrading in tensile strength when exposed to water.

U.S. Pat. No. 4,762,643 discloses compositions of flocced mineral materials combined with fibers and/or binders in a water resistant sheet. These products, made from swelled, layered flocced silicate gel materials, are stable to a temperature of approximately 350–400° C., however, at higher temperatures they begin to degrade, and they are not able to maintain structural stability above 800° C. The poor heat resistance of these materials makes them unsuitable for fireblocking applications.

All of the above mentioned patent disclosures are incorporated herein by reference. A solution to the varied technical problems described in these disclosures would represent an advancement in the art.

SUMMARY OF THE INVENTION

An object of the present invention is to provide a fireblocking paper that is both strong and flexible and which is capable of preventing the propagation of flame and has high burnthrough prevention capabilities. In preferred embodiments, paper according to the invention will pass the Federal Aviation Administration (FAA) burnthrough requirements. This test evaluates the burnthrough resistance of insulation materials when exposed to a high intensity open flame. Requirements of the above-referenced Proposed Rule for burnthrough resistance are that the material prevents penetration of a 1800–2000° F. (982–1092° C.) fire/flame from a burner held 4 inches from the material for at least 240 seconds. Additionally, the material shall not allow more than 2.0 Btu/ft$^2$ per second on the cold side of the insulation specimens at a point 12 inches from the front surface of the insulation blanket test frame. In addition to the burnthrough requirements, the material must also pass the radiant panel test in Part VI of Appendix F of the Rule, also incorporated by reference. This Proposed Rule ensures that materials meeting its requirements will not contribute to the propagation of a fire. Paper according to the invention can also be made water repellent. Furthermore, the inorganic fibers used in the fireblocking paper have a diameter above the respirable range, which provides a safety benefit.

The foregoing objects are achieved using paper made predominately from modified aluminum oxide silica fibers. The fibers are modified by acid extraction such that a portion of the silicon atoms in the silicon dioxide are bonded to hydroxyl groups. Paper made from these fibers using conventional papermaking technology has proven to be relatively flexible and strong as compared to prior art inorganic papers, while at the same time offering the desired burnthrough characteristics.

In one aspect the invention is a high tensile strength fireblocking paper comprising about 60 to about 99.5 percent by weight acid extracted inorganic fibers comprising silicon dioxide and aluminum oxide, wherein a portion of the silicon atoms in the silicon dioxide are bonded to hydroxyl groups, and about 0.5 to about 40 percent by weight organic binder fibers. Paper prepared consisting primarily of modified silica fibers and about 1 to about 5 percent by weight polyvinylalcohol fibers, for example, has been evaluated and shown to have exceptional tensile strength as compared to inorganic paper materials known in the prior art.

However, to obtain good burnthrough properties it is desirable to include other components in the paper. Therefore, paper prepared according to preferred embodiments of the invention generally comprises between about 60 to about 99.5 percent of the modified aluminum oxide silica fibers. The paper also includes up to about 40 percent by weight of an organic thermoplastic fiber binder having a limiting oxygen index (LOI) of about 27 or greater. In particularly preferred embodiments, additional organic binder fibers polyvinylalcohol or vinyl fibers are used in addition to the organic thermoplastic fibers.

In particularly preferred embodiments, organic thermoplastic fibers having high LOI are used as a binder in amounts of about 0.5 to about 20 percent by weight of the finished paper. Polyphenylene sulfide (PPS) fibers are particularly preferred In embodiments, relatively low melting point organic fibers, such as polyethylene fibers, may also be included in the paper according to the invention. In this context, relatively low melting means melting at a temperature of about 300° F. or lower.

Particulate mineral fillers, conventionally used in papermaking, may also be advantageously incorporated in the paper according to the invention. Particularly preferred are those mineral fillers having high temperature and flame resistance, such as titanium dioxide.

In another preferred embodiment, a pre-ceramic inorganic polymer resin is incorporated into the paper according to the invention, such as by coating.

Water resistance is advantageously provided to the paper using a treatment, such as a cured fluoropolymer coating.

Further objects and advantages of this invention will become apparent from a consideration of the drawings and description which follows.

DETAILED DESCRIPTION OF THE INVENTION

Figure 1:
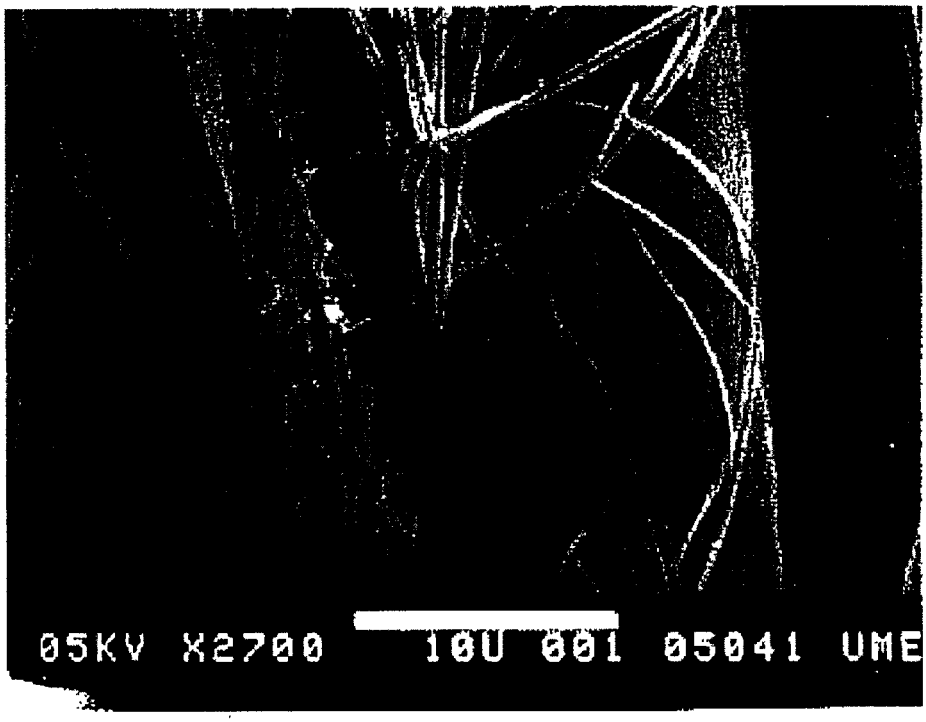
FIG. 1 is a scanning electron microscope (SEM) photomicrograph image of the fireblocking paper described in Example 2 at 2700× magnification.

In referring to the components of the paper, "percent by weight" means the weight percentage of the component with respect to all the components in the finished paper, unless expressly stated otherwise.

In referring to the composition of the modified aluminum oxide silica fibers, "percent by weight" means the weight of each component with respect to the totality of the modified aluminum oxide silica fibers.

"Basis Weight" refers to pounds of basis weight per 3000 square feet, unless expressly stated otherwise.

The terms silica, silicon dioxide, and $SiO_2$ are used herein interchangeably except as expressly stated otherwise. These terms include silicon dioxide that has been modified to include a portion of silicon atoms bonded to hydroxyl groups. Thus, the weight of silicon dioxide includes the weight of these silicon atoms and the hydroxyl groups bonded to them.

The terms alumina, aluminum oxide, and $Al_2O_3$, are used herein interchangeably except as expressly stated otherwise. These terms include minor amounts of other aluminum oxides, such as $Al_3O_6$, and any aluminum oxide hydrates that may be present.

The fireblocking paper of the present invention comprises about 60 to about 99 percent by weight of a high performance modified aluminum oxide silica staple fiber pre-yarn or sliver. Generally, between about 85 and about 99 percent by weight, preferably between 90 and 98 percent by weight, of the modified aluminum oxide silica fibers is silicon dioxide. A lesser portion, generally between about 1 and about 5 percent by weight of the modified aluminum oxide silica fibers is aluminum oxide.

Optionally, the modified aluminum oxide silica fibers contain up to 10 percent by weight alkaline oxides. More preferably, the modified aluminum oxide silica fibers contain less than 1 percent by weight $Na_2O$ or $K_2O$ or a combination thereof. In an exemplary preferred embodiment, the fibers contain about 95.2 percent by weight silica, 4.5 percent by weight aluminum oxide, and 0.2 percent by weight alkaline oxides. Alkaline earth oxides and metal oxides may be included in the fibers as impurities, in a collective amount generally less than 1 percent by weight.

The fibers preferably have a diameter of about 6 to about 15 microns, more preferably between about 7 to about 10 microns. The fibers have a length between about 2 mm and 76 mm, preferably about 12 mm. The mean fiber diameter used in a preferred exemplary embodiment is 9.2 microns, with a standard deviation of 0.4 microns, and a length equal to about 12 mm. As a result of the relatively large fiber diameter, the preferred fibers according to the invention will generally not produce fragments in the respirable range of (below about 3 to 4 microns). Consequently, these fibers do not carry the health risks associated with typical glass fibers having fiber diameter distributions that extend into the respirable range.

By "modified" is meant that the fibers are acid extracted to overcome the glassy properties of the native fibers and so that a portion of the silicon atoms have hydroxyl groups attached thereto. In preferred embodiments about 40 percent of the silicon atoms are bonded to hydroxyl groups. However, lesser or greater amounts may be practical to achieve a soft, fleecy feel to the fibers. Preferably, modification is done by acid extraction, as described in WO 98/51631, herein incorporated by reference. In performing the modification, a special starting fiber prepared by a winding drum process during fiber spinning is used, and components that do not add to the fibers' flame and heat resistance are removed through the acid extraction. Modified aluminum oxide silica fibers suitable for use with the invention are available under the tradename belCoTex® from belChem Fiber Materials GmbH of Germany.

These fibers possesses characteristics which are unique in comparison to other inorganic fibers in that they provide high temperature and chemical resistance, including long-term temperature resistance at 1000° C. and at the same time possess characteristics of organic materials similar to cotton or natural fibers. They are fleecy, soft, pleasant to touch, with a voluminous structure and excellent insulating properties, and are easily processed on ordinary textile equipment.

Glass fibers of discrete lengths obtained from chopping continuous strands, although commonly referred to as "staple fibers", are distinctly different from belCoTex® staple fiber slivers. The unique combination of properties possessed by belCoTex® is a result of both the raw fiber material used and the chemical treatment applied. The crystalline or glassy characteristic nature of the native silica fiber sliver has been overcome by the application of acid extraction to extract those components which will not contribute to high temperature resistance. In addition to supporting the high temperature resistance, the extraction process also generates the fleecy soft cotton-like feel and behavior of the refined fiber.

The fibers used in connection with the present invention, unlike conventional silica fibers, are not pure $SiO_2$ but contain aluminum oxide ($Al_2O_3$) as an additional component. Furthermore, about 40% of the Si atoms are attached to terminal OH (hydroxyl) groups while about 60% generate the three-dimensional $SiO_2$ network. The OH groups contribute to the cotton-like softness and behavior, the low specific weight, and the fiber's property profile in general. It is theorized that the OH groups in the silica network of belCoTex® result in some degree of attraction and possibly hydrogen bonding similar to that in cellulose papers, perhaps contributing to the unusually high strength of the paper.

The fireblocking paper according to preferred embodiments of the invention also comprises from about 0.5 to about 40 percent by weight organic thermoplastic fibers having a limiting oxygen index (LOI) of greater than about 27. Heating of these thermoplastic fibers above their melting temperatures causes them to soften and melt, and subsequently bind the inorganic fibers together once the paper has been cooled. In preferred embodiments, the organic thermoplastic fiber is included in an amount of about 0.5 percent by weight to about 20 percent by weight. High temperature flame resistant thermoplastic fibers such as poly (p-phenylenesulfide) (PPS) or poly(1,4-thiophenylene) are particularly preferred. PPS has a limiting oxygen index (LOI) of 34, meaning that the nitrogen/oxygen mixture in air must have at least 34% oxygen for PPS to ignite and burn when exposed to a flame. This makes PPS a suitable and preferred organic heat and flame resistant fiber, since it does not support combustion in air when exposed to a flame.

Without wishing to be bound by theory, it is this aspect of the primary binder mechanism that is believed to account for the fireblocking paper's unusual resistance to high temperature flames and subsequent integrity after long exposures at high temperatures. SEM photomicrographs shown in FIGS. 5, 6, 7, and 8 show fine fiber networks bridging adjacent fibers that are believed to be residual PPS binder material that has remained in the structure after the burn test. This residual material appears as a fiber-like network, or skeletal structure, that acts to continue binding adjacent fibers in the nonwoven structure. It is also likely that the high LOI of the organic thermoplastic material causes them to remain in the matrix even after exposure to high temperature flames for periods time which would be expected to entirely remove other organic fiber binder materials. Thus the combination of the "soft" modified silica fibers with the high LOI organic thermoplastic fibers is believed to yield fireblocking paper with unique properties.

In particularly preferred embodiments, PPS is present in amounts of up to about 20 percent by weight. PPS fiber is commercially available as Torcon® from Toray of NY, or as PROCON® from Toyobo of Japan. Other high temperature and flame resistant thermoplastic fibers having limiting oxygen indexes of approximately 27 and above, more preferably 30, which may also be suitable as high-LOI organic thermoplastic fibers include, without limitation: aromatic polyketones, aromatic polyetheretherketone (PEEK), polyimides, polyamideimide (PAI), polyetherimide (PEI), and fire resistant polyesters.

The fireblocking paper may contain up to about 20 percent by weight additional organic fiber binder. The function of this binder fiber is to provide strength to the sheet during the forming process on the paper machine, on equipment during subsequent processing steps such as the application of a water repellant treatment or during slitting, and during the installation of the finished paper in the end-use application, into the aircraft fuselage for example. Preferred embodiments include approximately 0.5–10% water-soluble polyvinylalcohol (PVOH) short staple fiber as a binder fiber. The PVOH fibers are at least partly soluble in water at elevated temperatures typically encountered in the drying section of the paper machine. More preferred embodiments contain 1–5% PVOH fiber, and most preferred embodiments contain 3–4% PVOH fiber. Typically, the PVOH fiber is chopped in lengths of approximately ¼ inch. Preferred water-soluble polyvinylalcohol fibers are commercially available under the trade name Kuralon K-II® from Kuraray America, Inc. of New York, N.Y.

High temperature flame resistant non-thermoplastic organic or inorganic fibers may also be used as part of the binding system. These fibers provide some strength to the sheet by becoming mechanically entangled with the other fibers as they are dispersed in the sheet during the forming process. Lengths greater than 5 mm are desirable. Suitable non-thermoplastic binding fibers include meta- and para-aramid, polybenzimidazole (PBI), Novoloid, and wool. Suitable inorganic binding fibers include fine glass fibers used to strengthen the sheet and as a processing aid. Such materials are preferably added in an amount of about 1 to about 5 weight percent.

Alternatively, resins or emulsions of acrylic, latex, melamine, or combinations thereof may be used in place of thermoplastic fibers as a binder. For example, these may include acrylonitrile, styrene butadiene (PBI), polyvinylchloride (PVC), and ethylenevinylchloride (EVC).

In another embodiment, the fireblocking paper may also contain particulate mineral fillers such as those typically used in papermaking; for example, kaolin or bentonite clay, calcium carbonate, talc (magnesium silicate), titanium dioxide, aluminum trihydrate and the like. Titanium dioxide, either in the anatase or rutile form, is preferred since it does not begin to melt at temperatures below about 1800° C. The paper may contain 0–30% or more mineral filler, which acts to fill the voids within the structure of the paper and on the surface of the sheet.

Depending on the particle size of the filler(s) used, retention of the filler particles in the sheet is governed by a combination of filtration (mechanical interception) and adsorption mechanisms. A number of retention aid chemicals are available from companies such as ONDEO Nalco Company of Naperville, Ill. to assist in the flocculation of small filler particles to the fibers, and are appropriately selected by those skilled in the papermaking art.

The fireblocking paper of this invention may be manufactured using typical papermaking processes known by those skilled in the art of papermaking. This involves dispersing the inorganic and organic fibers in a dispersing medium, typically water, and diluting the fiber slurry or "furnish" to the desired consistency. Secondary additives may include those typically used in alkaline papermaking for the retention of mineral fillers including, but not limited to: wet end starch, cationic and/or anionic retention aid polymers of various molecular weights, defoamers, drainage aids, additives for pH control, and pigments and/or dyes for color control.

If used, a dilute slurry of mineral filler may be introduced to the furnish at any number of points in the typical "headbox approach" system piping. The headbox approach system allows for the furnish to be metered, diluted to the desired consistency, mixed with the desired additives, and cleaned before being discharged onto the forming section of the paper machine. Water is removed from the papermaking stock on the forming section via gravity drainage and suction, leading to the formation of a fibrous web. Additional water may be removed from the web by wet pressing, followed by drying which is usually accomplished by contacting the web with steam-heated dryer cans. Other drying methods may be used, such as air-impingement, air-through, and electric infrared dryers.

The fireblocking paper may be treated with a means for imparting water repellency. Preferred treatments include a fluoropolymer emulsion such as Zonyl® RN available from Du Pont of Wilmington, Del., but various other means, such as a silicone coating for example, may be used. The application of the treatment may be accomplished on-line during the papermaking process if a coating station is available, or in a subsequent step in which the fibrous web is saturated in the fluoropolymer solution and then dried.

Additional high temperature durability and binding strength may be provided by incorporating a pre-ceramic resin into the paper. Suitable resins are the DI-100 or DI-200 resins manufactured by Textron Systems of Wilmington, Mass. These resins are inorganic, silicon-based polymers with unique high temperature properties. The DI resins are thermally stable to temperature over 538° C. (1000° F.) but become ceramic at around 1000° C. In an aircraft fire, temperatures would likely exceed that required to burn out the PVOH or other organic binder fibers. However, the inorganic polymer resin would be cured in use (converted to a full ceramic) and would thus provide additional strength to the fireblocking paper at actual in-use temperatures.

The use of inorganic polymer resins is not limited to the DI resins. Other suitable pre-ceramic resins include, without limitation, polyureasilazane resin (Ceraset SN-L from Hercules Co.), polycarbosilanes, polysilazanes, polysiloxanes, silicon-carboxyl resin (Blackglas available from Allied Signal/Honeywell, or Ceraset by Lanxide Corp, Du Pont/Lanxide), and alumina silicate resin (such as CO2 available from Applied Polymerics). These resins may typically be applied to the paper once it is formed using papermaking equipment such as a size press coater, rod coater, blade-type coater, or using textile padding equipment, or by spraying.

The basis weight of the paper may range from about 5 to about 250 lb/3000 $ft^2$, and thickness may range from about 0.5 mil to about 250 mils, although these dimensions are not critical. Although a paper as light as 5 pounds per ream may not pass the FAR burnthrough requirements, it may be advantageous to use multiple layers of a very thin lightweight paper. Air space between such layers could further improve the paper's insulating capability and may prove desirable, for example, in the heat flux portion of the burnthrough test. Tensile strength of the paper is generally greater than about 30 g/in per pound of basis weight in the machine direction. In preferred embodiments tensile strength is greater than about 40 g/in per pound of basis weight in the machine direction. In most preferred embodiments, tensile strength is greater than about 50 g/in per pound of basis weight in the machine direction.

The following examples demonstrate the manufacture of a fireblocking paper of the present invention. The Examples are not intended to be limiting of the invention, which is defined by the appended claims.

EXAMPLE 1

The basis weight of the fireblocking paper produced in this example was targeted at approximately 70 $g/m^2$ or 43 lb/3000 $ft^2$ and thickness was targeted at 0.8 mm or 31.5 mils. It was produced on a fourdrinier pilot paper machine with a width of approximately 28 inches. The paper consisted of 99 percent by weight belCoTex® and 1 percent by weight polyvinylalcohol (PVOH) binder fiber. Using a spray system, a fluoropolymer emulsion consisting of Zonyl® RN was applied to the dry paper and subsequently cured in an oven at 350–450° F. for about 3 to 6 minutes or until dry. Previous attempts at applying the water repellant treatment in the wet papermaking furnish resulted in a weak paper that lacked tensile strength. Spraying the treatment onto the surface of the paper allowed strength to be maintained while imparting hydrophobic properties.

EXAMPLE 2

This example was produced in the same manner as Example 1, except the paper consisted of 97 percent by weight belCoTex® and 3 percent by weight PVOH binder fiber.

EXAMPLE 3

The fireblocking paper of this example was produced in the same manner as Example 1, except it was comprised of 80 percent by weight belCoTex® fiber, 19 percent by weight Ryton® poly(p-phenylenesulfide) (PPS) fibers, and 1 percent by weight PVOH fibers. The treated paper was heated at 550° to 600° F. for about 6 minutes to completely melt the thermoplastic PPS fibers and cure the fluoropolymer treatment. After heating, the PPS fiber is completely melted within the interstices of the sheet and binds adjacent fibers.

Table 1 summarizes physical test results of the previous examples. "Start" and "End" indicate that the sample tested came from the beginning or end of the production quantity of that example, and "Front" and "Back" indicate the position of the sample in the cross-machine direction (front or back side of the paper machine). "MD" and "CD" refer to machine direction and cross-machine direction respectively. Unless expressly stated to the contrary, comparative tensile strength refers to comparative tensile strengths in the machine direction.

TABLE 1

Physical Properties of Fireblocking Paper

| | | Basis Weight lb/3000 sq ft | | Thickness mils, 4 psf | | Tensile MD g/in | | Tensile CD g/in | | Frazier ft 3/min | | Loss on Ignition* % | |
|---|---|---|---|---|---|---|---|---|---|---|---|---|---|
| | | Front | Back | F | B | F | B | F | B | F | B | F | B |
| Ex. 1 | Start | 39.7 | 39.8 | 33 | 33 | 2416 | 2515 | 803 | 976 | 316 | 317 | 13.8 | 14.2 |
| | End | 45.6 | 45.5 | 36 | 36 | 2860 | 2353 | 1179 | 1161 | 294.6 | 287.8 | 11.4 | 11.2 |
| Ex. 2 | Start | 40.6 | 40.5 | 31 | 31 | 5978 | 4856 | 2370 | 2120 | 280.5 | 280.5 | 12.9 | 13.5 |
| | End | 40.1 | 40.5 | 31 | 31 | 5423 | 4862 | 2293 | 2354 | 286.3 | 284.8 | 13.5 | 13.4 |
| Ex. 3 | Start | 42.9 | 43.0 | 36 | 34 | 1854 | 1878 | 843 | 781 | 284.8 | 286.3 | 28.0 | 27.7 |
| | End | 42.0 | 41.8 | 34 | 34 | 2007 | 2036 | 800 | 740 | 284.8 | 287.8 | 30.2 | 29.5 |
| Ex. 3** | | | | | | 1944 | 3187 | 791 | 999 | 285 | 285 | | |

*Loss on Ignition test: heat sample to 1000° F. (537.8° C.) measure weight loss
**Tensile after heating to 325° C. 1 min The tensile strength properties of the papers of Examples 1 through 3 as a function of basic weight are shown in Tables 2.

TABLE 2

Tensile Strength Properties of Examples 1–3

| Present Invention | | Example 1 | Example 2 | Example 3 |
|---|---|---|---|---|
| Tensile Strength | g/in | 2466 | 5417 | 1866 |
| Basis Weight | lb/3000 sq ft | 39.7 | 40.6 | 42.0 |
| Tensile (g/in) per pound of basis weight | | 62.1 | 133 | 44.4 |

A comparison of these materials with materials according to the prior art is shown in Table 3.

TABLE 3

Tensile Strength Properties, Prior Art

| Prior Art | | U.S. Pat. No. 4,885,058 | U.S. Pat. No. 4,885,058 | U.S. Pat. No. 4,885,058 | U.S. Pat. No. 5,567,536 | U.S. Pat. No. 5,294,199 |
|---|---|---|---|---|---|---|
| Tensile Strength | g/in | 1612 | 1086 | 998 | 1000 | 1226 |
| Basis Weight | lb/3000 sq ft | 38.0 | 38.1 | 38.6 | 200 | 137 |
| Tensile (g/in) per pound of basis weight | | 42.4 | 28.5 | 25.9 | 5.0 | 8.9 |

Thus, a strong paper may be made using PVOH fibers in combination with modified alumina-silica fibers. It has further been found that incorporating organic thermoplastic fibers yields a fireblocking paper with much better fireblocking protection.

When a sample of the fabric of Example 3 was subjected to a Bunsen burner flame and the result examined under a scanning electron microscope (SEM), three distinct regions were visible in the burnt fabric: a white hot region closest to the point of application of the flame, an unburned region farthest from the point of application of the flame, and a transitional region between the white hot and unburned region. Comparison of a sample subjected to a Bunsen burner burn through test with a sample subjected to a more rigorous FAA test permitted assessment of the role of the thermoplastic organic fiber (PPS in this preferred example).

Figure 2:
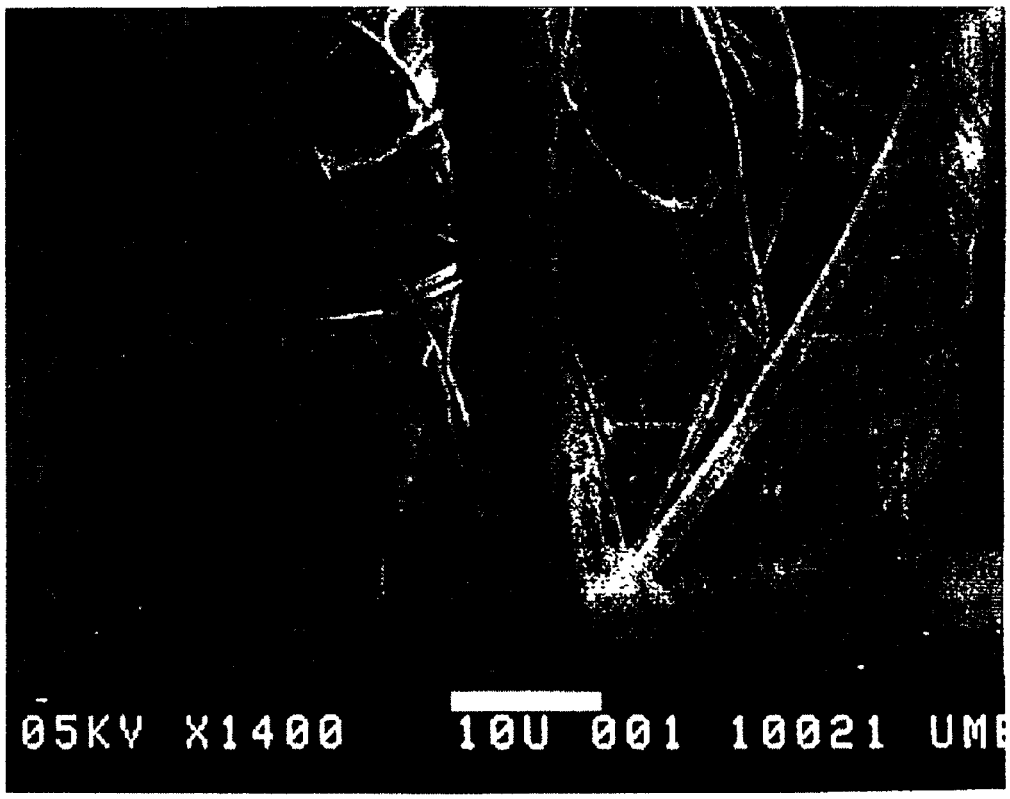
FIG. 2 is an SEM photomicrograph image at 1400× magnification of a region of a fabric according to the invention after a burn through test.
Figure 3:
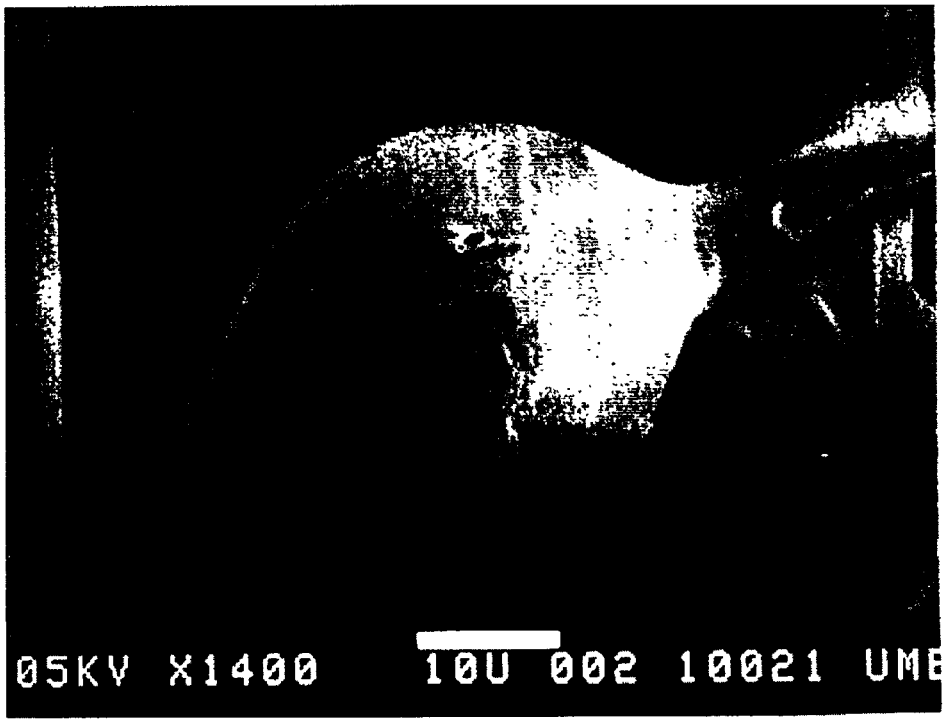
FIG. 3 is an SEM photomicrograph image at 1400× magnification of a region of a fabric according to the invention after a burn through test, showing what are thought to be partially melted PPS fibers that have coalesced.
Figure 4:
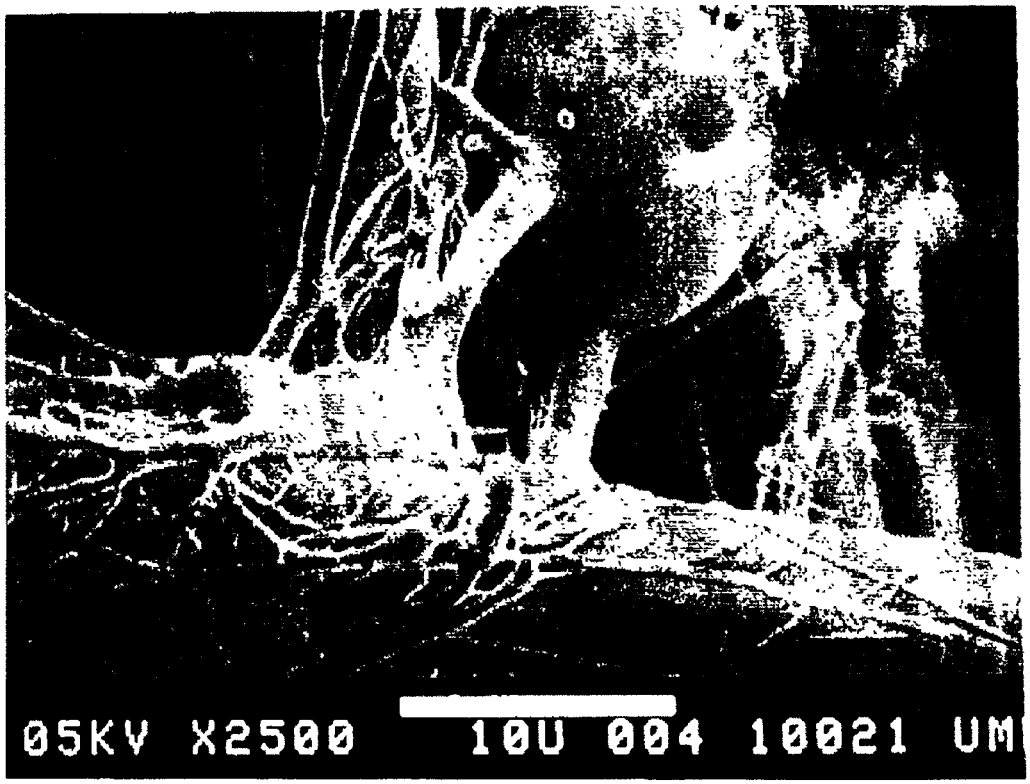
FIG. 4 is an SEM photomicrograph image at 2500× magnification of a white hot burned region of a fabric according to the invention after a burn through test.
Figure 5:
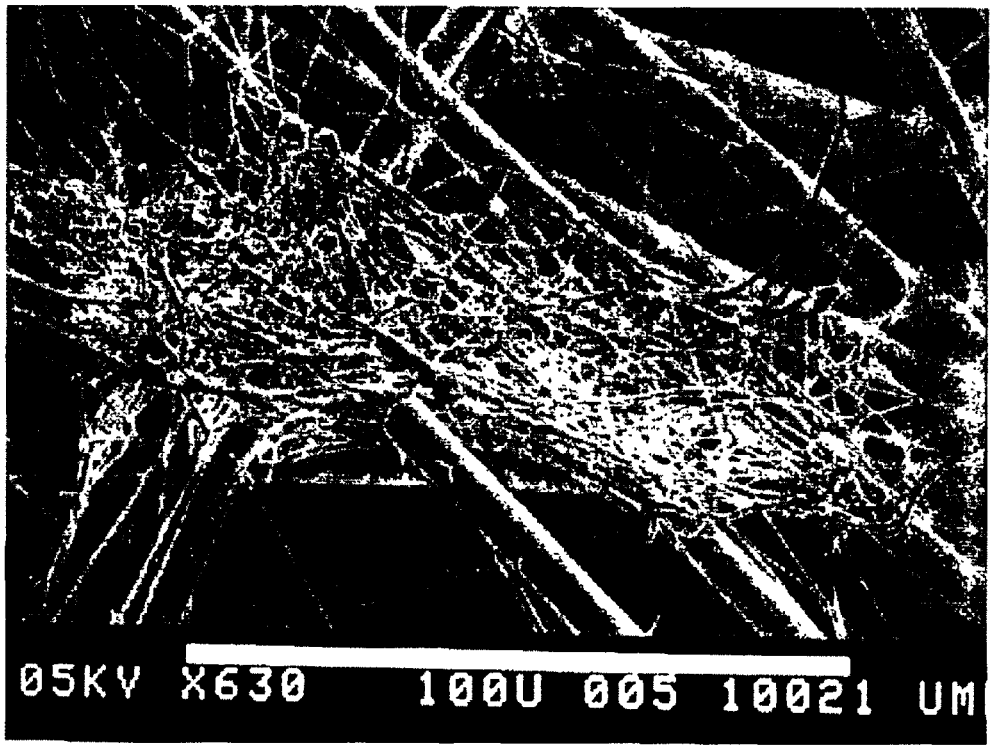
FIG. 5 is an SEM photomicrograph image at 630× magnification of a white hot burned region of a fabric according to the invention after a burn through test.
Figure 6:
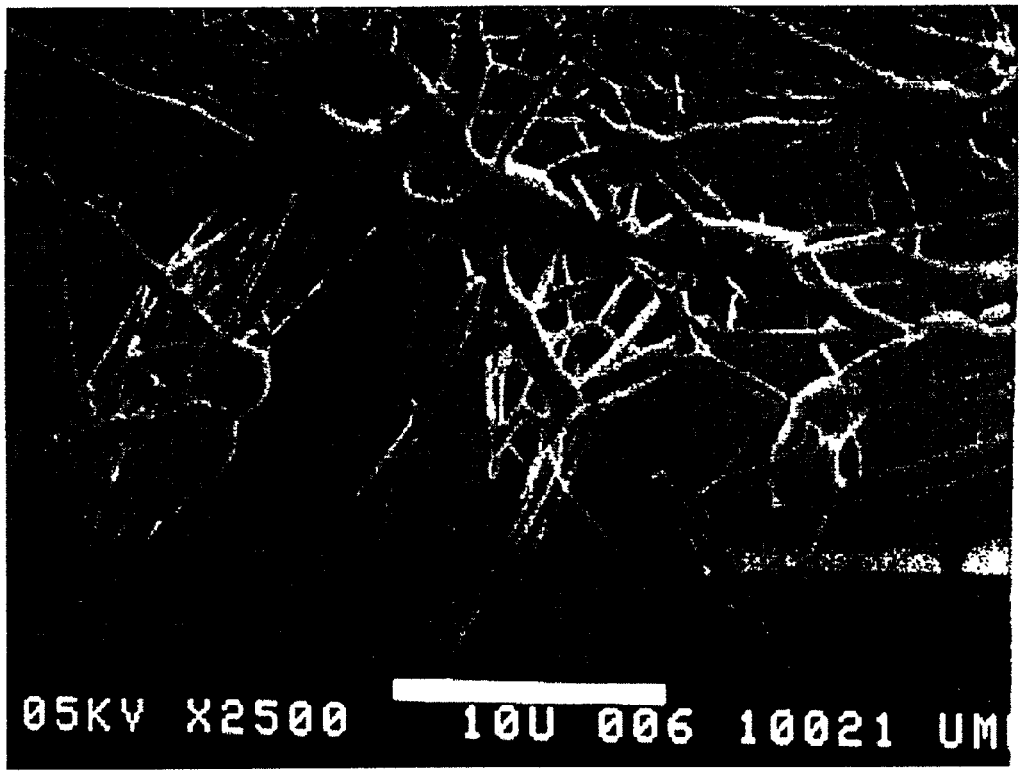
FIG. 6 is an SEM photomicrograph image of a portion of the fabric shown in FIG. 5 at 2500× magnification.
Figure 7:
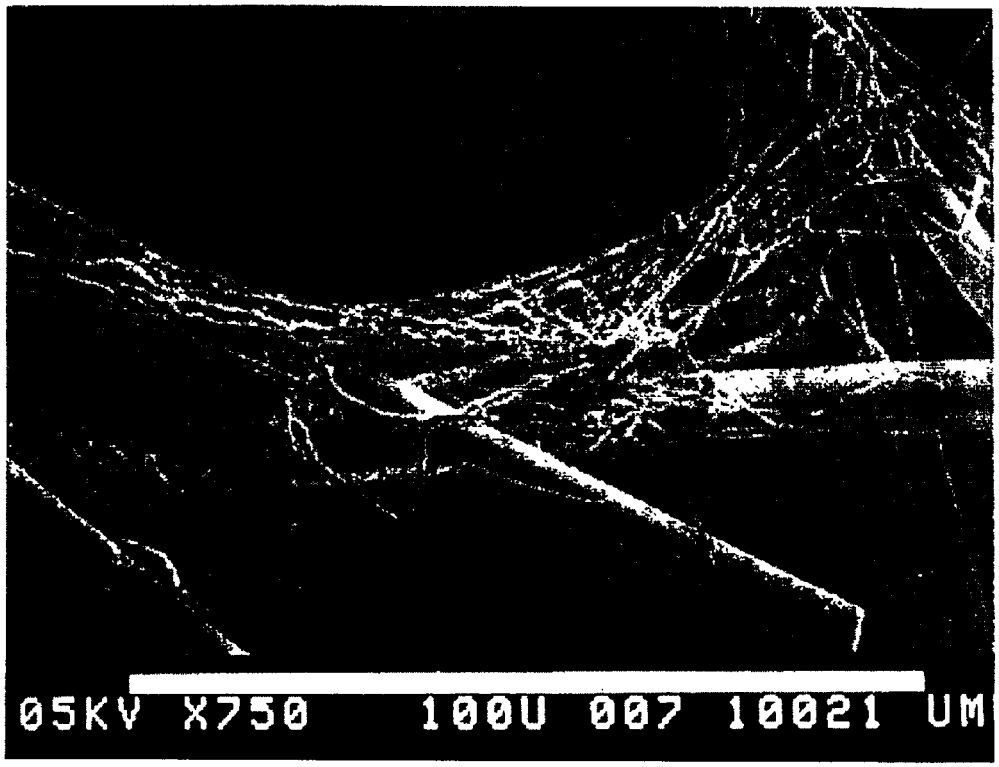
FIG. 7 is an SEM photomicrograph image at 750× magnification of a white hot burned region of a fabric according to the invention after a burn through test.
Figure 8:
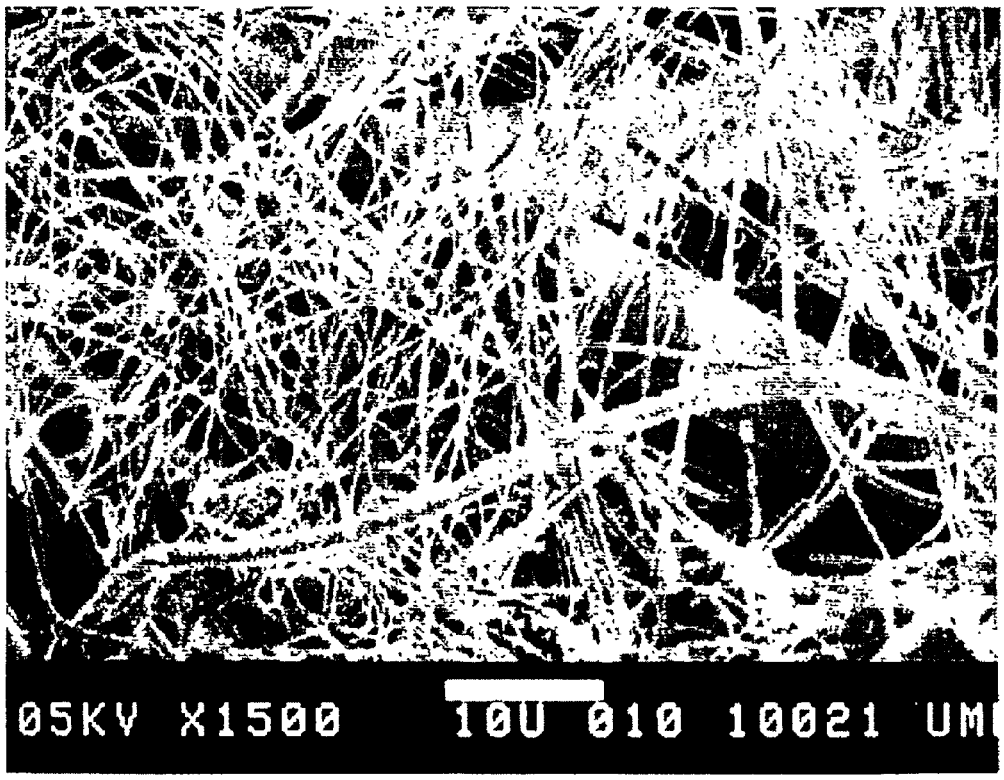
FIG. 8 is an SEM photomicrograph image at 1500× magnification of a transitional region from of a fabric according to the invention after a burn through test.
Figure 9:
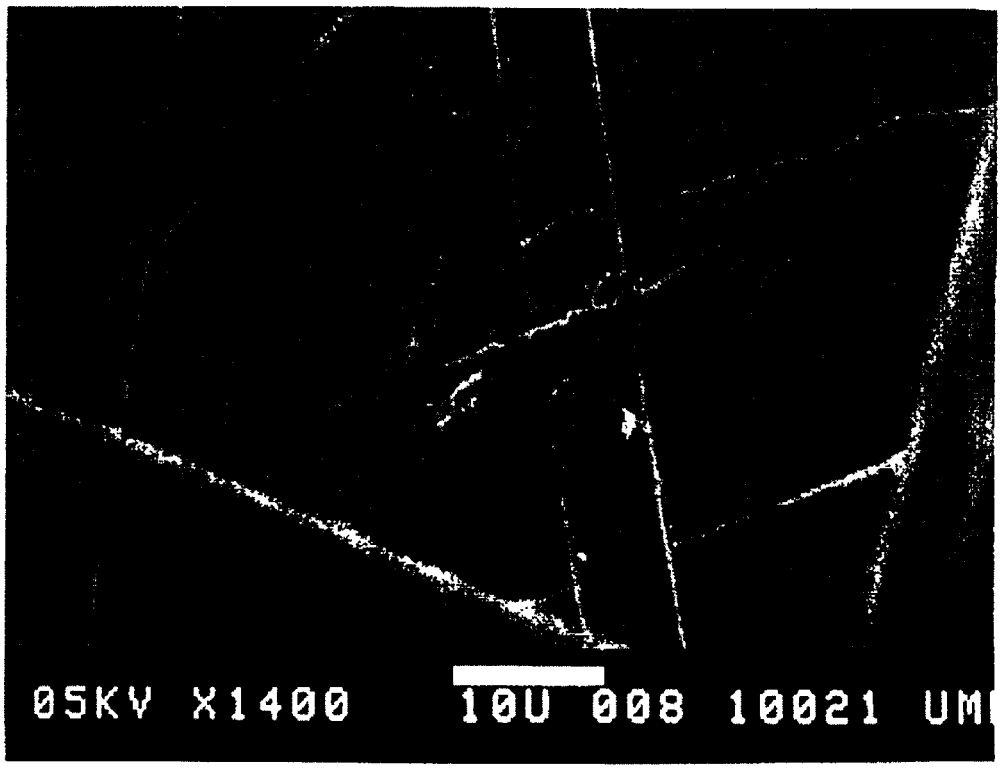
FIG. 9 is an SEM photomicrograph image at 1400× magnification of a fabric according to the invention after an FAA burn through test.

In an unburned region farthest from the point of application of the flame, melted PPS fibers can be seen binding the inorganic fibers. In FIG. 2, the larger fibers are inorganic fibers (having a diameter on the order of 9 microns), the smaller fibers are PVOH. The diffuse, melted material is believed to be PPS, evidenced by the fact that this melted material is absent from the region subjected to higher temperatures. In FIG. 3, nodular formations of what is believed to be PPS are shown binding the other fibers in the paper. In FIGS. 4 through 7, in the region subjected to more severe temperatures, the skeletal remains of PPS fiber are seen forming a network. In the samples subjected to an FAA burn through test seen in FIG. 8, the presence of lesser but still significant amounts of this network are also observed. The presence of this thermoplastic material after a burn through test is surprising by itself, the formation of structure enhancing network as shown in the Figures is even more surprising.

The material described in Example 3 has shown superior results in testing for both long-term hot wet conditions and burnthrough resistance against high temperature flames. Table 4 shows test results for hot wet conditions that describe the material of Example 3 as having a lower percentage of breaking strength loss in hot wet conditions. The material was tested for residual strength loss after being exposed to temperatures of 70 degrees Celsius and 95% relative humidity for 500 and 1000-hour cycles. Table 5 describes results obtained from two testing labs wherein materials prepared substantially in accordance with Example 2 and Example 3 were evaluated for burnthrough resistance. Materials described in Example 3 passed burnthrough resistance testing following the FAA requirements.

TABLE 4

Retained Tensile Strength - Hot Wet Conditions

| Properties | Test Method | Unit | Test Temp | Results Example 1 | Example 2 | Example 3 |
|---|---|---|---|---|---|---|
| Properties after conditioning at 70° C. /95% R.H / 500 hrs | | | | | | |
| Percentage change in breaking strength MD | ASTM C800 | % | RT | −68.1% | −74.9% | −62.5% |
| Percentage change in breaking strength CMD | | % | | −84.8% | −72.7% | −60.1% |
| Water Absorption (Repellency) | AIMS 04-10-00 | g | | 27.0 g | 25.1 g | 10.7 g |
| Percentage change mass | AIMS 04-10-00 | % | | −3.4% | −3.0% | −1.8% |
| Properties after conditioning at 70° C. /95% R.H / 1000 hrs | | | | | | |
| Percentage change in breaking strength MD | ASTM C800 | % | RT | −87.7% | −73.8% | −66.2% |
| Percentage change in breaking strength CMD | | % | | −76.4% | −62.7% | −59.6% |
| Water Absorption (Repellency) | AIMS 04-10-00 | g | | 9.7 g | 21.0 g | 11.2 g |
| Percentage change mass | AIMS 04-10-00 | % | | Specimen Contaminated | −1.8% | −1.0% |

Source: EADS AIRBUS GmbH

TABLE 5

Burnthrough Testing Results

| Sample | Test Method | Test Lab | Test Duration Min (4 Min) | Pass/ Fail |
|---|---|---|---|---|
| Example 2 | FAR 25.853, Part 25, Part VII of Appendix F | International Aero, Inc. Burlington, WA | 122 Sec. | FAIL |
| Example 3 | FAR 25.853, Part 25, Part VII of Appendix F | Daimler Chrysler Aerospace Airbus GmbH, Bremen, Germany | >6 Min | PASS |

EXAMPLE 4

A fireblocking paper that may be produced on a Fourdrinier paper machine is comprised of the following principal components in approximate weight percentage: 83 percent by weight belCoTex® fiber, 5 percent by weight Kuralon K-II polyvinylalcohol fiber, and 12 percent by weight precipitated calcium carbonate (PCC).

Those skilled in the art of papermaking will be able to select an appropriate retention system to retain as much as is practical of the PCC in the sheet and hence lose little to the papermachine whitewater. This is commonly accomplished by measuring the cationic and/or anionic charge demand of the principal components by titration, and then selecting appropriate retention aid polymer(s) and/or additives that are able to balance the zeta potential of the system. For example, a system having anionic fibers and an anionic filler will have a cationic demand, therefore, a cationic retention polymer is selected to bring the overall zeta potential or charge close to zero. Fillers are best retained at zeta potentials near zero, where it is possible to create flocs of fiber and filler that are not undesirably large. Devices such as the Mutek Particle Charge Detector can be used to perform the titration and calculate the charge demand.

EXAMPLE 5

A fireblocking paper that may be produced on a Fourdrinier paper machine in the manner of Example 4, comprised of the following principal components in approximate weight percentage: 86 percent by weight belCoTex® fiber, 4 percent by weight Kuralon K-II polyvinylalcohol fiber, 10 percent by weight anatase $TiO_2$.

EXAMPLE 6

The composition of a paper produced using ordinary papermaking processes is as follows: 89 percent by weight belCoTex® fiber, 8 percent by weight inorganic pre-ceramic polymer resin, and 3 percent by weight PVOH binder fiber.

What is claimed is:

1. A fireblocking paper comprising:

about 60 to about 99.5 percent by weight inorganic fibers having silicon dioxide as the main component and aluminum oxide as a lesser component, wherein a portion of the silicon atoms in the silicon dioxide are bonded to hydroxyl groups, and about 0.5 to about 40 percent thermoplastic organic fibers having a limiting oxygen index greater than about 27, wherein the thermoplastic organic fibers comprise poly (p-phenylenesulfide).

2. The fireblocking paper of claim 1, wherein the thermoplastic organic fibers are selected from the group consisting of: poly (p-phenylenesulfide), poly (1,4-thiophenylene), aromatic polyketones, aromatic polyetheretherketone, polyimides, polyamideimides, polyetherimide, fire resistant polyesters and mixtures thereof.

3. The fireblocking paper of claim 1, wherein the inorganic fibers have a mean fiber diameter of about 6 to about 15 microns.

4. The fireblocking paper of claim 1, wherein the inorganic fibers have a mean fiber diameter of about 7 to about 10 microns.

5. The fireblocking paper of claim 1, wherein the inorganic fibers comprise between 85 and 95 percent by weight silicon dioxide, between about 1 percent by weight and about 5 percent by weight aluminum oxide, and between about 0.1 percent by weight and about 1 percent by weight alkali metal oxides.

6. The fireblocking paper of claim 1, wherein the inorganic fibers have been acid extracted.

7. The fireblocking paper of claim 1, further comprising about 0.5 to about 40 percent by weight pre-ceramic resin.

8. The fireblocking paper of claim 7, wherein said pre-ceramic resin is selected from the group consisting of silicones, polyureasilazanes, polycarbosilanes, polysilazanes, polysiloxanes, silicon-carboxyl resins, and alumina silicate resins.

9. The fireblocking paper of claim 1, comprising non-thermoplastic organic fibers in an amount up to about 20 percent by weight.

10. The fireblocking paper of claim 9, wherein said non thermoplastic fibers are selected from the group consisting of aramid fibers, polybenzimidazole fibers and wool fibers.

11. The fireblocking paper of claim 1, further comprising up to about 20 percent by weight of a relatively low melting organic binder fiber.

12. The fireblocking paper of claim 1, further comprising about 0.5 to about 5.0 percent by weight polyvinylalcohol fibers.

13. The fireblocking paper of claim 1, comprising about 1 to about 20 percent by weight thermoplastic organic heat and flame resistant fibers having a limiting oxygen index greater than about 27.

14. The fireblocking paper of claim 1, having a machine direction tensile strength greater than 1000 grams per inch.

15. The fireblocking paper of claim 1, having a machine direction tensile strength greater than about 1600 grams per inch.

16. The fireblocking paper of claim 1, having a basis weight greater than about 5 pounds/3000ft$^2$, and a machine direction tensile strength per pound of basis weight of greater than about 30 grams per inch.

17. The fireblocking paper of claim 13, having a machine direction tensile strength per pound of basis weight of greater than about 40 grams per inch.

18. The fireblocking paper of claim 1, wherein said portion of silicon atoms in the silicon dioxide bonded to hydroxyl groups is about 40 percent.

19. The fireblocking paper of claim 1, wherein said paper prevents penetration of a 1800° F. to 2000° F. flame from a burner held about 4 inches from the material for 240 seconds.

20. A fireblocking paper comprising:

about 60 to about 99.5 percent by weight inorganic fibers having silicon dioxide as the main component and aluminum oxide as a lesser component, wherein a portion of the silicon atoms in the silicon dioxide are bonded to hydroxyl groups, and about 0.5 to about 40 percent thermoplastic organic fibers having a limiting oxygen index greater than about 27, and further comprising between 1 percent by weight and 20 percent by weight particulate mineral filler.

21. The fireblocking paper of claim 20, wherein said particulate mineral filler is anatase or rutile titanium dioxide.

22. A fireblocking paper comprising:

about 60 to about 99.5 percent by weight inorganic fibers having silicon dioxide as the main component and aluminum oxide as a lesser component, wherein a portion of the silicon atoms in the silicon dioxide are bonded to hydroxyl groups, and about 0.5 to about 40 percent thermoplastic organic fibers having a limiting oxygen index greater than about 27 and further comprising a waterproof treatment.

23. The fireblocking paper of claim 22, wherein said waterproof treatment is a cured fluoropolymer coating.

24. A high tensile strength paper comprising:

about 60 to about 99.5 percent by weight acid extracted inorganic fibers comprising silicon dioxide and aluminum oxide, wherein a portion of the silicon atoms in the silicon dioxide are bonded to hydroxyl groups, and about 0.1 to about 10 percent by weight polyvinylalcohol organic binder fibers, and about 0.5 to about 40 percent organic thermoplastic fibers having a limiting oxygen index greater than about 27.

25. The high tensile strength paper of claim 24, wherein said organic thermoplastic fibers comprise poly(p-phenylenesulfide) fibers.

26. The fireblocking paper of claim 25, comprising:

about 1.0 to about 10 percent by weight polyvinylalcohol fibers;

about 0.5 to about 20 percent by weight poly(p-phenylenesulfide) fibers;

about 60 to about 99.5 percent by weight of said acid extracted inorganic fibers; and an inorganic filler.

* * * * *